US005584673A

United States Patent [19]

Rein

[11] Patent Number: 5,584,673

[45] Date of Patent: Dec. 17, 1996

[54] DEVICE FOR REDUCING THE PRESSURE OF A COMPRESSOR IN THE IDLING AND SHUTDOWN MODE

[75] Inventor: Karl Rein, Vienna, Austria

[73] Assignee: Hoerbiger Ventilwerke Aktiengesellschaft, Vienna, Austria

[21] Appl. No.: 413,469

[22] Filed: Mar. 28, 1995

[30] Foreign Application Priority Data

Mar. 30, 1994 [AT] Austria ..... 676/94

[51] Int. Cl.[6] ..... F04B 49/00

[52] U.S. Cl. ..... 417/308; 417/290; 417/304

[58] Field of Search ..... 417/290, 296, 417/302, 303, 304, 308, 310, 440

[56] References Cited

U.S. PATENT DOCUMENTS

| | | | |
|---|---|---|---|
| 3,961,862 | 6/1976 | Edstrom et al. | 417/290 |
| 4,052,135 | 10/1977 | Shoop et al. | 417/304 |
| 4,076,491 | 2/1978 | Moody, Jr. et al. | 417/310 |
| 4,219,312 | 8/1980 | Mori et al. | 417/302 |

FOREIGN PATENT DOCUMENTS

| | | | |
|---|---|---|---|
| 301968 | 12/1989 | Japan | 417/290 |
| 405087079 | 4/1993 | Japan | 417/440 |
| 406123295 | 5/1994 | Japan | 417/310 |
| 2133585 | 7/1984 | United Kingdom | 417/310 |

*Primary Examiner*—Timothy Thorpe
*Assistant Examiner*—Ted Kim
*Attorney, Agent, or Firm*—Watson Cole Stevens Davis, P.L.L.C.

[57] ABSTRACT

A device for reducing pressure in a compressor when it is in the idling and shut-down mode, in the induction manifold of which there is an induction control valve that controls the passage through the induction manifold, is provided with a bypass line that incorporates a closeable relief valve. The device for reducing pressure incorporates a spring-loaded pressure keeper valve that can be adjusted to the desired pressure, and an additional second relief valve that is arranged in parallel to the first relief valve. This second relief valve is acted upon by the pressure immediately upstream of the compressor in the induction manifold, and opens an additional relief path as soon as this pressure exceeds a pro-determined level when the compressor is shut down. The two relief valves and the pressure keeper valve can be incorporated into a common housing.

6 Claims, 6 Drawing Sheets

DEVICE FOR REDUCING THE PRESSURE OF A COMPRESSOR IN THE IDLING AND SHUTDOWN MODE

BACKGROUND OF THE INVENTION

The present invention relates to a device for reducing the pressure of a compressor during idling and shut-down.

In the induction manifold of such a device, there is an induction control valve that controls its cross-sectional area. This is bypassed by a bypass channel, the output of which runs through a pressure accumulator to a user. An adjusting device operated from the pressure in the pressure accumulator is provided for the induction control valve, and a return line that can be shut off by a relief valve is fed back to the induction side from the pressure accumulator. The device for reducing the pressure is incorporated in the return line.

As is known, one possibility for controlling the output from compressors and the like, for both piston-type compressors with reciprocating pistons as well as for rotary-type compressors, in particular screw-type compressors, is to vary the open cross-section of the induction manifold and thereby throttle the quantity of medium that is drawn in, either more or less. When this is done, it is not desirable to close off the induction line completely when the compressor is idling since then there will be a relatively large underpressure in the vicinity of the compressor. This is a disadvantage, in particular, in the case of rotary and, above all else, in the case of screw-type compressors, because when this is done lubrication and cooling of the compressors is interrupted.

It is already known that, in order to avoid this problem, the induction control valve can be bypassed by a bypass channel so that when the compressor is idling there is always a specific minimal output that helps prevent harmful underpressure in the compressor, but which ensures adequate cooling and lubrication for the compressor.

The quantity of medium that is delivered when idling, even though small, must be fed back to the induction side of the compressor, which can be done in the case of air that is blown off to the atmosphere. It is known that in order to do this, a return line that can be shut off by means of a relief valve can be run back from the pressure accumulator to the induction side and incorporated in a device for reducing pressure.

In known embodiments, the device that is used to reduce pressure consists of a nozzle with a fixed unobstructed cross-section that is of such dimensions that in normal idling operation the pressure that is required to ensure the operation is maintained within the pressure accumulator. For this reason, this reducer nozzle is frequently of relatively small dimensions. The reduction of pressure that is achieved from full operating pressure starting from idling pressure proceeds very slowly. In the same way, the air venting time when the compressor is shut down is correspondingly long. It is determined by the size of the fixed nozzle and the size of the pressure accumulator, as well as by existing operating pressure. The nozzle can be partially obstructed very easily by impurities that are carried in with the medium that is being delivered, for this reduces the unobstructed cross-section and the time required to reduce pressure is made even longer. The result of this is that the medium pressure within the container rises despite the fact that the system is idling. This causes increased energy consumption to drive the system because during this time the compressor operates at an excessively high pressure that must subsequently be reduced.

It is an object of the present invention to improve pressure reduction in compressors in a simple manner so that the desired pressure is achieved both during idling and when the compressor is shut down, this being done as quickly as possible and in a manner that is appropriate for the particular operating conditions.

SUMMARY OF THE INVENTION

According to the present invention, this problem has been solved in that the device for reducing the pressure incorporates a spring-loaded pressure keeper valve that can be adjusted to the desired pressure, and an additional second relief valve that is arranged in parallel to the first relief valve, which is acted upon by the pressure in the induction line immediately upstream of the compressor and which opens an additional pressure relief path as soon as this pressure exceeds a pre-determined limit when the compressor is shut down. The desired idling pressure can be obtained and maintained with the help of the adjustable pressure keeper valve regardless of the cross-section of the discharge opening. The discharge opening can be made larger, which reduces the danger of obstruction. Should restrictions of the cross-section occur, these can be balanced out by a pressure keeper valve that opens somewhat more. This ensures that the pressure keeper valve provides for equally rapid pressure relief.

The additional relief valve that is provided additionally also opens up a second relief path when the compressor is shut down, so that in this case there is a rapid and complete reduction of pressure. This second relief valve is activated by the pressure immediately ahead of the compressor in the induction manifold which, as is known, rises rapidly as soon as the compressor is shut down and a non-return valve in the induction line is closed. Thus, the present invention ensures a rapid reduction of pressure for idling operation and a rapid reduction of pressure on shut-down; above all else, this results in considerable savings of energy in the case of repeated changes from one operating mode to another.

In a further embodiment of the invention, the pressure keeper valve and the two relief valves can be combined in a common housing to form a pressure reduction unit. This has the advantage that a compact structural unit is achieved and the required connecting lines can be made much smaller.

According to another feature of the present invention, the common housing for the pressure reduction unit can be combined with the housing of the induction control valve to form a common structural unit. In this case, all of the devices that serve to control the compressor are combined in a single housing in the vicinity of the induction manifold so that connecting lines can be eliminated. Only a small amount of space is required for the complete system.

In a preferred embodiment of the present invention, the common housing for the pressure reduction unit incorporates a cylinder bore, a piston being sealed and guided in the two end sections of this; the cylinder bore between the two pistons is divided by two partitions, each of which incorporates a central bore; an extension of one of the two pistons passes through each of these, one bore being provided as a guide for the one piston, which is spring-loaded by a spring in the direction towards the bore and on which the partition that incorporates the bore comes to rest so as to form a seal. An extension of the second piston passes through the other bore and this has a seal in the area of its end. This seals the bore in the partition where it passes through. Provision is also made such that the housing incorporates five connections, of which one leads into the cylindrical space on the spring-loaded side of one piston and is connected with the control line for the induction control valve. The second connector opens out into the cylindrical space of the opposing piston and is connected with the induction line directly ahead of the compressor. The third connector leads into the space between the two partitions of the cylinder bore, is connected to the pressure accumulator, and can be connected to the fourth connector and the fifth connector, which both open out into the atmosphere or into the induction line through the pressure relief lines through the two pistons, either in alternation or together, depending on the pressure that is introduced.

Using this design configuration, all of the valves of the pressure-reduction device according to the present invention, which is to say the relief valves as well as the pressure keeper valve, can be combined so as to occupy very little space. This has not only structural advantages, but also favours the incorporation with the remaining control devices for the compressor. In addition, this embodiment of the device is simple and can be manufactured in a cost-effective way with very little outlay.

Within the context of the present invention, it is also possible to incorporate an adjustable delay relay in the operating device for the relief valve that is incorporated ahead of the pressure keeper valve. It is preferred that this consist of a solenoid valve that, when the compressor is started up, delays the closing of the relief valve. The effect of this configuration is that when the compressor is started up after being shut down, the relief valve initially remains open for some time and that the pressure keeper valve remains activated, which prevents the pressure in the pressure accumulator exceeding the idling pressure during this time.

This also permits an initial warm-up period for the compressor system in idling operation and prevents the delivery pressure of the compressor rising too rapidly during the start-up period. It is preferred that the delay relay be incorporated in the power supply line of the solenoid valve that activates the relief valve of the pressure keeper valve. This arrangement is based on expediency because if used, it is possible to use a simple electrical delay relay.

The invention will now be described in more detail, by way of example only, with reference to the accompanying drawings, in which:

DESCRIPTION OF THE PREFERRED EMBODIMENTS

Figure 1:
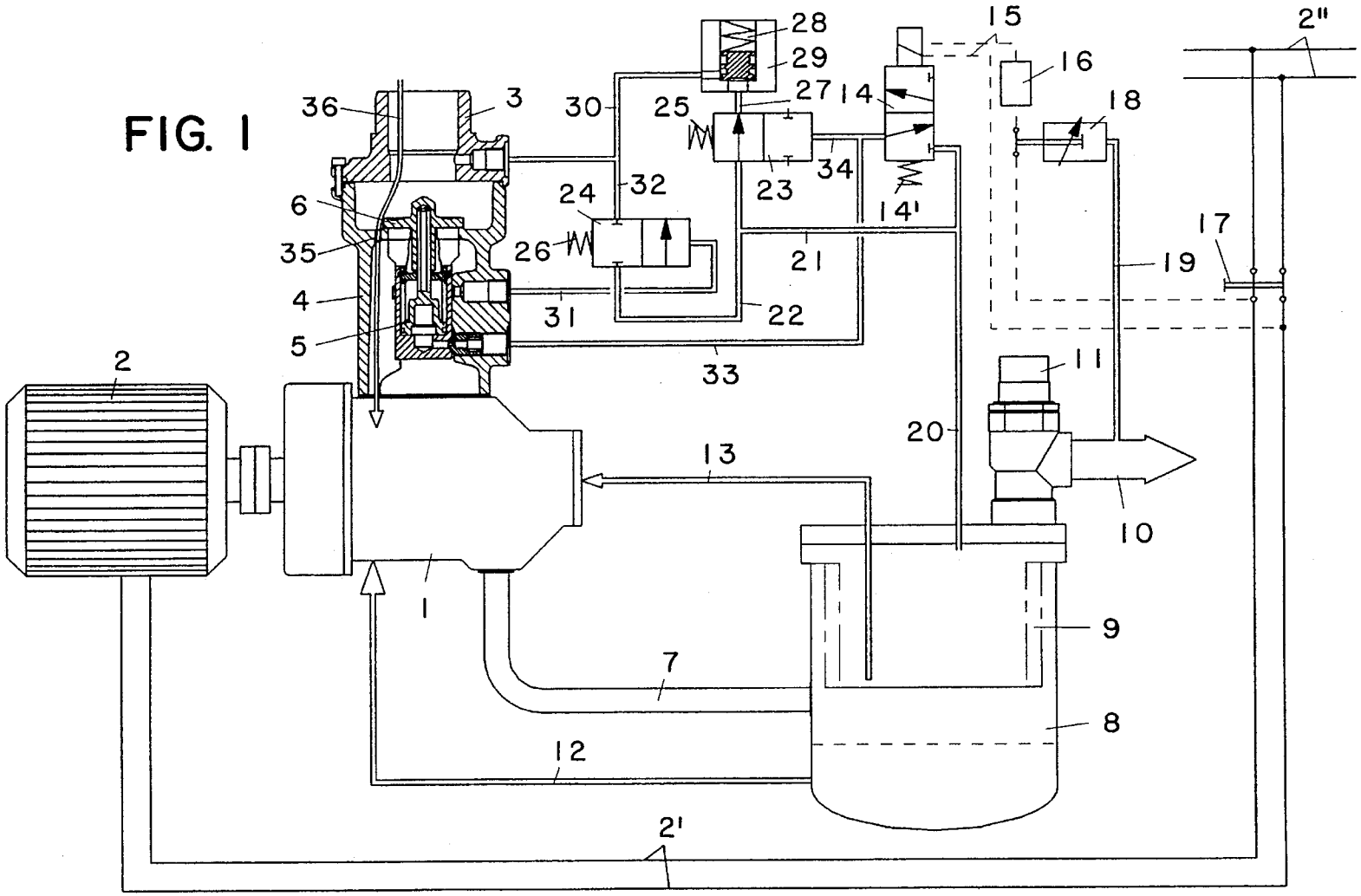
FIGS. 1 to 4 show switching diagrams for one embodiment of the present invention in the start, full-load, idling and stop operating modes.

The embodiment shown in FIGS. 1 to 4 comprises a compressor 1 in the form of a screw-type compressor driven by an electric motor 2. The power supply for the electric motor 2 is provided by associated circuits 2' connected via an electric switch 17 to a power supply system 2". This is a system common for such purposes, for example, system to start a three-phase motor with a star-delta switch.

The compressor 1 has an induction manifold 3, which is shown enlarged, and which incorporates an induction control valve 4 that incorporates an end cap 6 that can be adjusted by means of an adjusting piston 5. This end cap 6 cuts off the induction line 3 in the direction of induction and also acts as a non-return valve in the opposite direction. The compressed medium passes from the compressor 1 through a pressure line 7 to a pressure accumulator 8 that is configured as an oil separator and which has, in its upper part, a fine filter 9. A supply line 10 leads from this to a user (not shown herein).

A so-called minimum pressure valve 11 is incorporated in the supply line 10. This closes when the pressure is released from the pressure accumulator 8 and prevents a simultaneous reduction of pressure at the user point. The minimum pressure valve 11 also closes if the pressure at the user point falls below the least-acceptable pressure so as to prevent the pressure within the pressure accumulator 8 from falling too rapidly, which would endanger the lubrication and the cooling of the compressor 1. Thus, this also ensures that there is always adequate medium pressure within the pressure accumulator 8 so as to ensure the supply of liquid from the pressure accumulator 8 to the compressor 1 that is in the form of a screw-type compressor. To this end, a liquid line 12 runs from the lower part of the accumulator 8 to the compressor I and an additional liquid line 13 is provided, and this runs from the fine filter 9 to the compressor 1. The liquid that is supplied through these lines 12, 13 serves to seal, cool, and lubricate the screw-type compressor.

In order to control the output of the compressor 1 and in order to maintain the correct pressure of the medium within the pressure accumulator 8, a solenoid valve 14 with a return spring 14' and some-other valves are provided. These will be described below. The solenoid valve 14 is activated through two power supply lines 15 that incorporate a delay relay 16 that is merely indicated in the drawings. In addition, the power supply line 15 is connected to a power supply system 2" via a switch 17 for the selective switching on and off of the control system and for on and off switching of the electric motor 2. Also included in the power supply line 15 is a pressure switch 18 that is connected through a pressure monitoring line 19 to the supply line 10.

A control line 20 runs from the fine filter 9 within the pressure accumulator 8 to the solenoid valve 14. This branches through a branch line 21 that also incorporates a branch 22, and these each lead to first and second pressure relief valves 23 and 24, both of which are acted upon by return springs 25 and 26. A pressure keeper valve 29 that is loaded by a spring 28 is connected to the pressure relief valve 23 through a line 27, and a pressure relief line 30 runs back from this into the induction manifold 3 of the compressor. The second pressure relief valve 24 is connected through a line 31 to the regulator valve 4.

The line 31 runs from a point of the regulator valve 4 at which the pressure in the induction line 3 is felt directly ahead of the compressor 1. Another line 32, which runs from the pressure relief valve 24, opens out into the pressure relief line 30 and thereby runs back to the suction line 3 in the same way. Finally, there is also a control line 33 that runs from the solenoid valve 14 into the cylinder space of the adjusting piston 5 of the induction control valve 4 and from which the branch line 34 opens out in the first pressure relief valve 23 in order to operate this.

Thus, control of the output of the compressor 1 is effected through the induction control valve 4, the end cap 6 of which changes the cross-section of the suction line 3 as required.

FIG. 1 shows the position that corresponds to the start phase of the compressor system. The switch 17 thereby starting the electric motor 2 and the compressor 9, and the pressure switch 18 are closed, and the delay relay 16 delays the switching of the solenoid valve 14 for a short while. During this delay time, the end cap 6 closes the induction control valve 4. Within its seat there is a bypass channel 35 through which a small quantity of air can be drawn in despite the closed induction control valve. This prevents an under-pressure forming within the compressor 1, and at the same time permits a small amount of pressure to build up in the pressure accumulator 8 in order to ensure the lubrication and cooling of the compressor 1, which is a screw-type compressor, through the two liquid lines 12 and 13. The pressure keeper valve 29 prevents an increase of pressure within the pressure accumulator 8 through the open pressure relief valve 23 beyond a pre-set value, so that the compressor system can warm up as it idles during this delay time.

Figure 2:
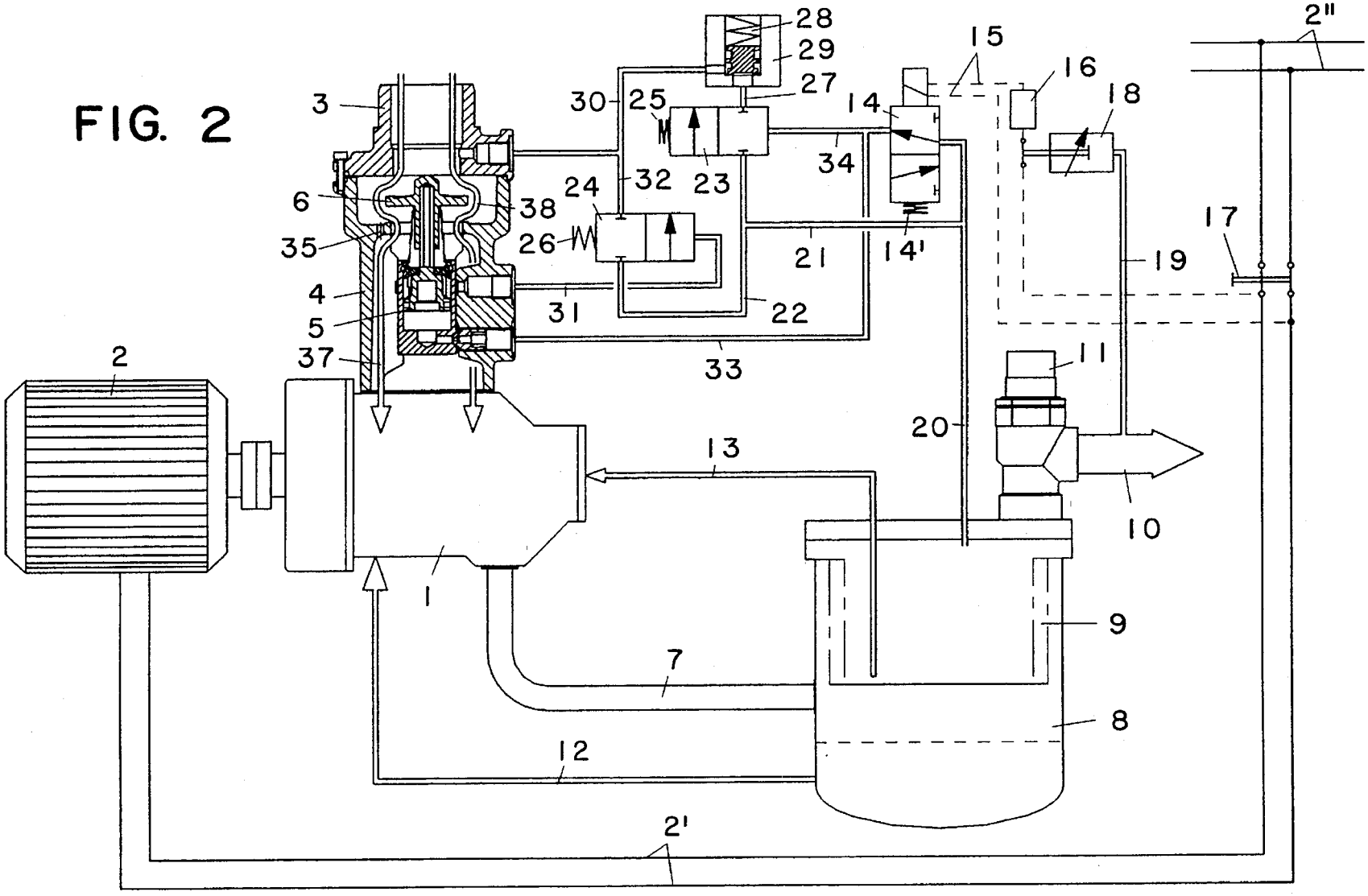

As soon as the delay time has expired, the solenoid valve switches into the position shown in FIG. 2. The medium pressure passes from the pressure accumulator 8 through the control line 20 and through the branch line 34 to the first pressure relief valve 23 so that this, too, is switched against the force of the spring 25. The pressure relief valve 23 is thus closed, as is shown in FIG. 2, in which the control device for the full-load operating mode is shown.

With the valves in this position, the control line 33 of the induction control valve 4 is also connected through the control line 20 to the pressure accumulator 8, so that the adjusting piston of the induction control valve 4 is acted on by the pressure that is felt in the pressure accumulator 8, moves out because of this, and moves the end cap 6 into the position of the greatest flow cross-section, as is indicated in FIG. 2 by means of two arrows 37 and 38. Thus, in the position of the control device, the compressor 1 is operating at full load and supplies the user (not shown herein) by way of the pressure accumulator 8 and the supply line 10.

If the user uses less pressure medium than the amount delivered by the compressor 1, the pressure within the user's system and in the supply line 10 will increase. This elevated pressure is passed on through the pressure monitoring line 19 to the pressure switch 18 that opens the electrical line at a pre-selected pressure and thus interrupts the connection to the solenoid valve 14. This then switches under the action of its return spring 14, which means that the control line 20 is closed by the solenoid valve 14.

Figure 3:
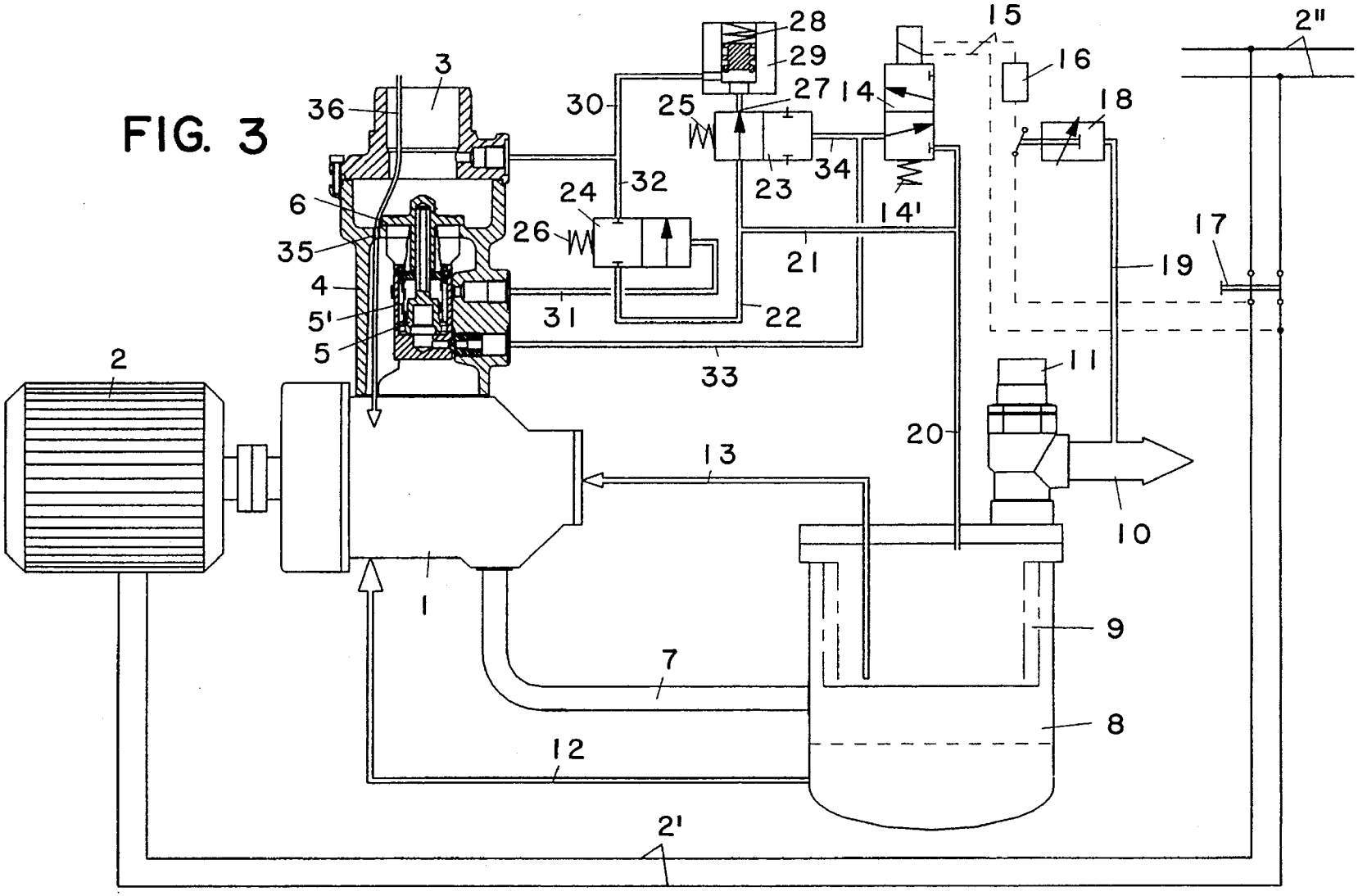

This arrangement of the control device is shown in FIG. 3 and corresponds to the idling mode. Because of the fact that the control line 20 is closed off, there is no pressure in the control line 33, so that the adjusting piston 5 returns to the closed position that is shown in FIG. 3; the adjusting piston 5 under the action of its return spring 5, and the end plate 6 because of the flow forces of the medium that is drawn in and act upon it. The bypass channel 35 remains open, however, so that even in the idling mode, medium is only drawn in through the bypass channel 35, as is indicated by the arrow 36.

Because the control line 20 is closed there is no pressure in the branch line 34 that leads to the relief valve 23. For this reason, the relief valve 23 is activated by its return spring 25 so that the line 21 that branches off from the control line 20 is connected to the pressure keeper valve 29 through the open relief valve 23 and the line 27. This means that the pressure accumulator 8 is vented through the pressure relief valve 23 until it reaches the reduced pressure to which this has been adjusted and this is subsequently maintained by the pressure keeper valve 29.

In the event that the selected pressure is exceeded, the pressure keeper valve 29 opens against the force of its spring 28 so that the excess medium can escape through the pressure relief line 30 into the inlet manifold 3. The second relief valve 24 remains closed during this mode of operation.

Thus, in the idling mode, when the first relief valve 23 is opened, the pressure within the pressure accumulator 8 drops very rapidly to a pre-determined value through the pressure keeper valve 29 and the relief line 30. In practice, this is an approximate value between 2 and 3 bar. This pressure is then maintained automatically throughout the whole of the idling mode. The rapid reduction of pressure results in energy savings because the unwanted compression of the medium is avoided. The minimum pressure that is maintained in the pressure accumulator 8 also ensures adequate lubrication and cooling of the compressor 1 during idling operation.

Figure 4:
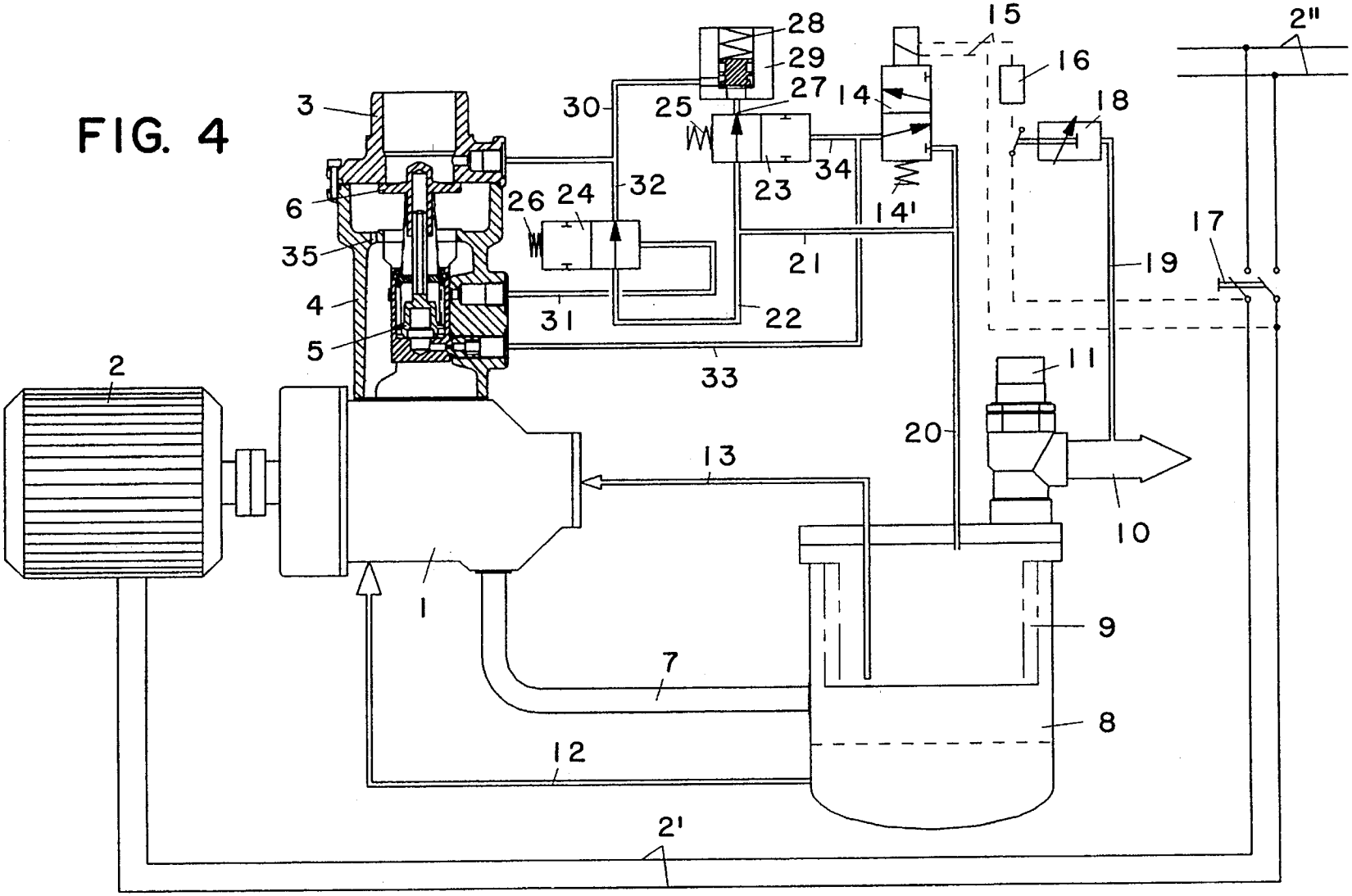

FIG. 4 shows the position of the valves when the compressor system is shut off. This is done by opening the switch 17 to shut off the electric motor 2 and the power supply line 15. If the system is shut off from the idling mode, then the pressure switch 18 is already open. The control line 20 is closed by the solenoid valve 14 but, in contrast to this, the first relief valve 23 is opened so that the pressure remaining in the pressure accumulator 8 can be released through the control line 20, the branch line 21, the relief valve 23, and the pressure keeper valve 29, and then through the pressure relief line 30 into the induction manifold 3.

When the electric motor 2 is switched off, the compressor 1 takes in no medium so that initially pressure medium can return to the induction control valve 4 along the pressure line 7 and through the compressor 1. This means that the end cap 6, which also acts as a non-return valve, is moved into the position shown in FIG. 4 under the action of the returning medium, and in this position it closes off the induction manifold 3.

The consequence of this is that the pressure in the induction manifold 3 rises in the vicinity of the induction control valve 4. This pressure passes through the line 31 to the second relief valve 24, which the switches open as the route between the branch line 22 from the branch line 21, and from the line 32; this route opens out into the pressure relief line 30. The pressure accumulator 8 is thus relieved still more through a second relief route. This means that when the compressor is shut down, the rapid relief of pressure from the pressure accumulator 8 and thus from the whole compressor system is ensured.

Figure 5:
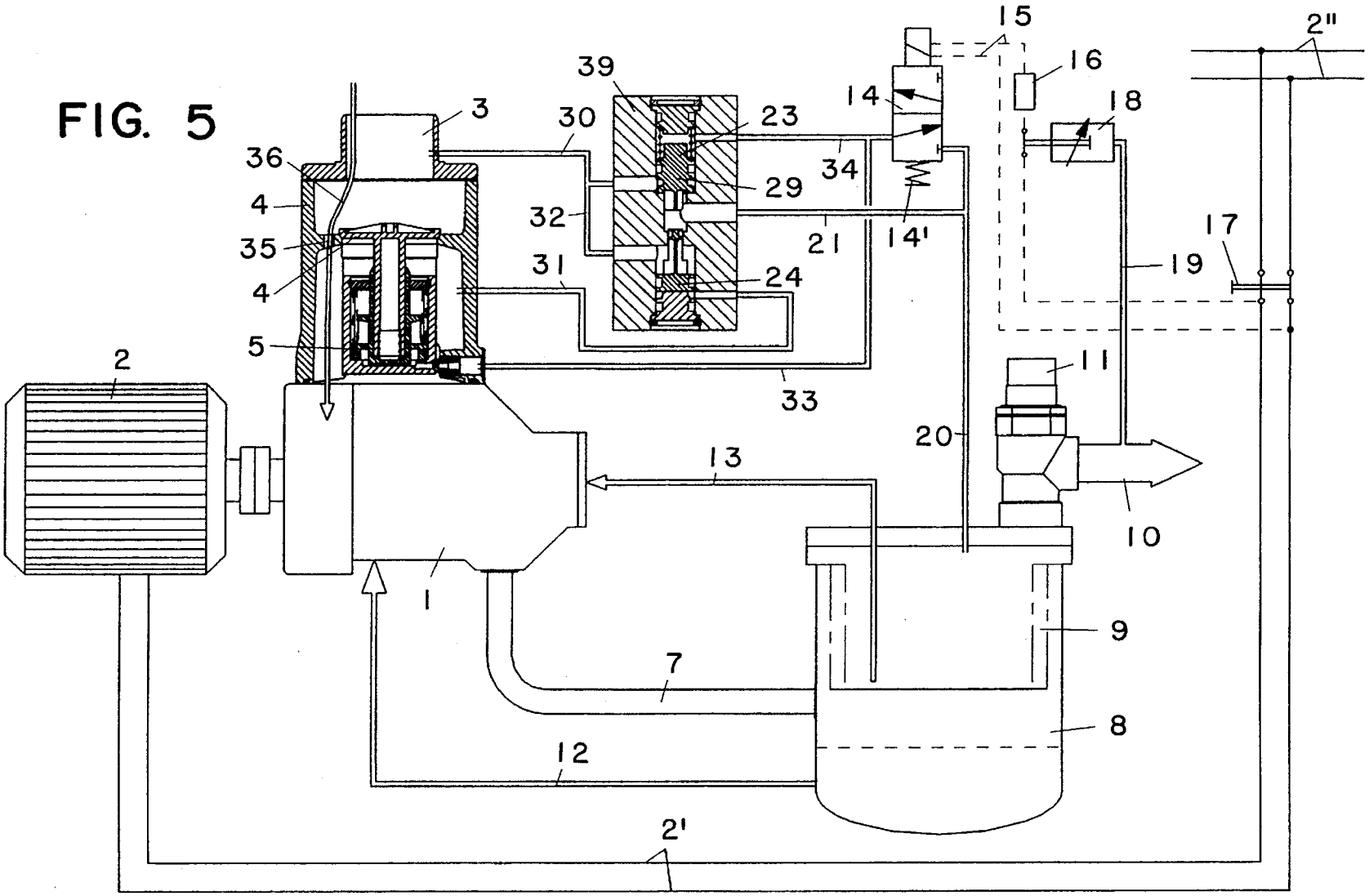
FIG. 5 is a switching diagram for a modified embodiment in the start mode.

FIG. 5 shows a modified embodiment in which the induction control valve 4 is of a different design than in the embodiment that is shown in FIGS. 1 to 4, although it operates in an identical manner. In addition, in FIG. 5, the essential valves of the device for lowering the pressure have been combined in a common housing 39 to form a pressure reduction unit.

FIG. 5 makes it plain that the common housing 39 contains the two pressure relief valves 23 and 24 and the pressure keeper valve 29. The line connections between the individual valves are, for the most part, provided in the common housing 39 itself, so that a number of lines can be eliminated. Compared to the embodiment that is shown in FIGS. 1 to 4, this results in simplification, which can be seen by comparing the drawings.

The operation of the device to reduce the pressure remains unchanged. FIG. 5 shows the operating state when the system is started up and can thus be compared with the arrangement that is shown in FIG. 1.

Figure 6:
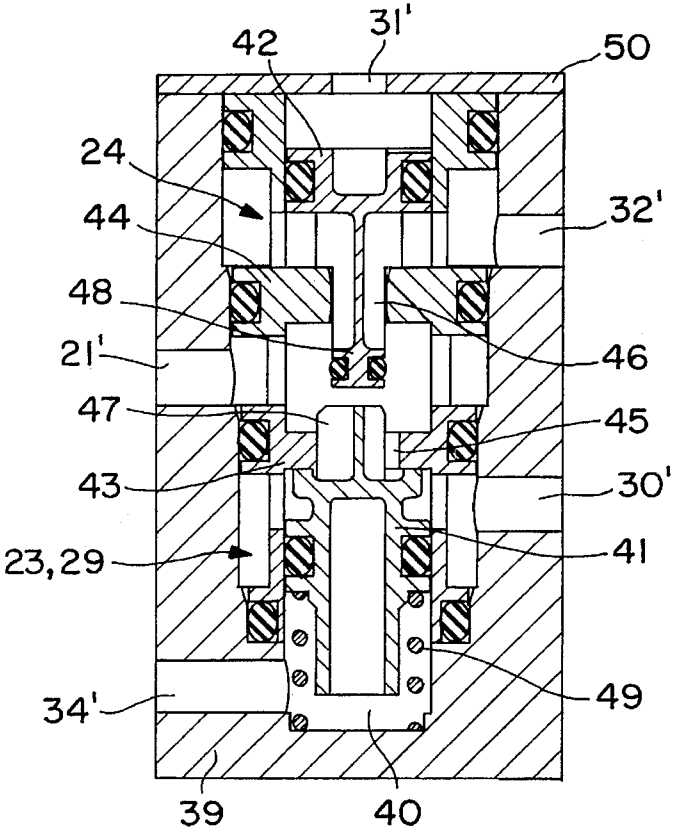
FIG. 6 is a longitudinal-cross-section through the combined pressure reduction unit according to the present invention.

FIG. 6 shows an embodiment of a common pressure reduction unit on a larger scale. The common housing 39 incorporates a cylinder bore 40 that is continuous over almost its entire length, although its diameter changes at a number of points; this cylinder bore is provided with five connectors. In order to clarify this, the individual connectors bear the identical reference numbers as the lines that are connected to them although each number is followed by an apostrophe.

In each of the two end sections of the bore 40, there is a piston 41 and 42 that effectively seals the bore. Between the two pistons, the cylinder bore 40 is divided by inserts that are inserted into it and these forms two partitions 43 and 44, each of which has a central bore 45 and 46. An extension 47 and 48 of each of the two pistons 41, 42 passes through each of the two bores 45 and 46, the bore 45 in the partition 43 being provided as a guide for the piston 41. To this end, the extension 47 is provided with ribs. The piston 41 is loaded in a direction towards the bore 45 by a spring 49 and thus forms a seal against the partition 43.

An extension 48 of the second piston 42 passes through the bore 46 in the partition 44. This extension 48 has a seal at its end area, and this seals the bore 46 when it passes through it.

Of the five connectors in the housing 39, the connector 34' leads into the cylindrical space on the spring-loaded side of the piston 41, and in the switching diagram shown in FIG. 5 is connected through the branch line 34 to the control line 33 for the induction control valve 4. The second connector 31' opens out into the cylinder space of the opposite piston 42 and is connected through the line 31 to the induction manifold 3, immediately ahead of the compressor 1. The third connector 21' leads into the space between the two partitions 43, 44 and is connected through the control line 20 to the pressure accumulator 8. Depending on the level of the pressure that is fed in, it is connected through the two pistons 41, 42 either in alternation or together, to the fourth connector 32', which leads to the pressure relief line 30, and to the fifth connector 30' that is connected directly to the pressure relief line 30.

Thus, the common housing 39 contains the first pressure relief valve 23, that is formed essentially from the spring-loaded piston 41 and which simultaneously forms the pressure keeper valve 29, and, in addition, the second pressure relief valve 24, the function of which is performed by the piston 42. Thus, by using such a combined pressure reduction unit, it is possible to achieve a considerable simplification of the overall system, eliminate a number of lines, and thus increase the operational reliability of the overall system that is used to reduce the pressure.

Figure 7:
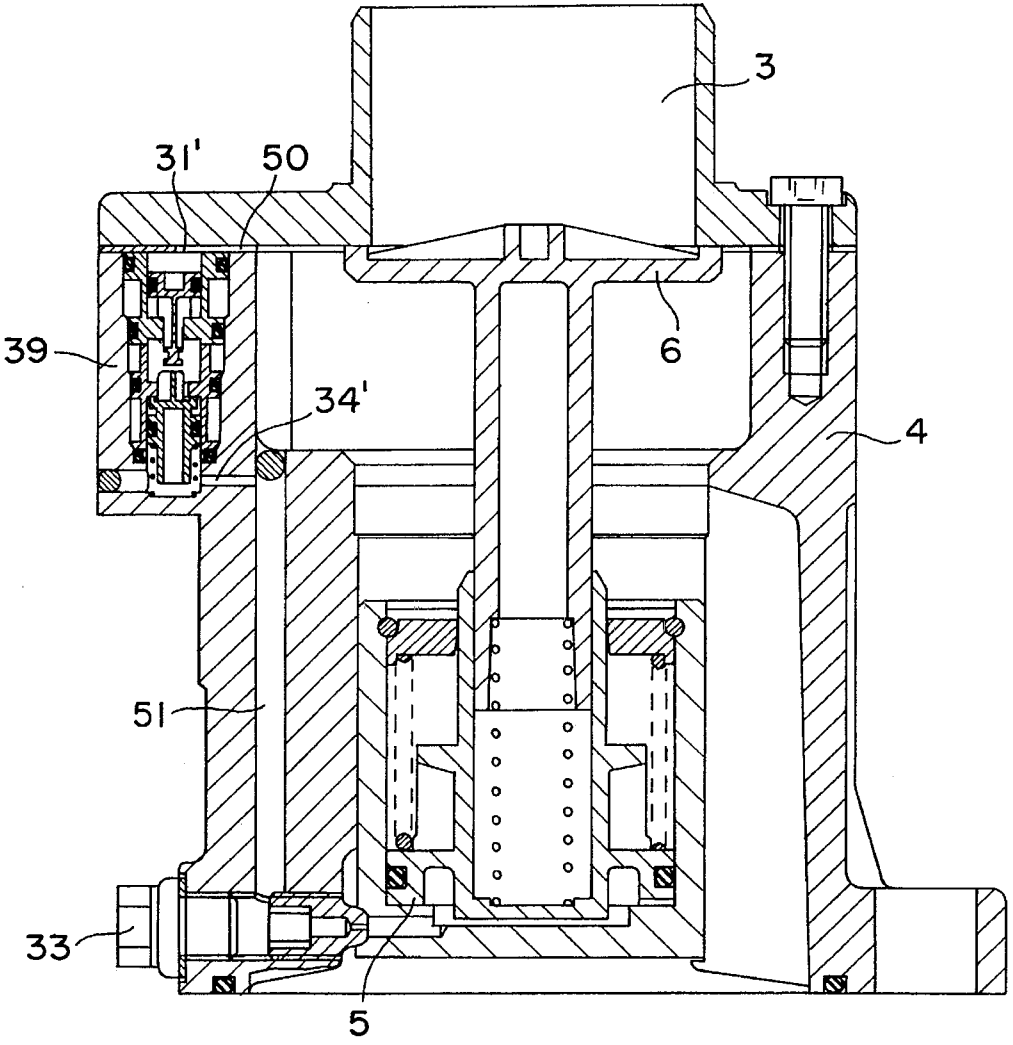
FIG. 7 is a longitudinal section through the induction control valve incorporating a pressure reduction unit.

Finally, FIG. 7 shows an embodiment in which the common housing 39 of the pressure control unit has been combined with the housing of the induction control valve 4 to form a common structural unit. The construction of the pressure reduction unit is thus the same as that shown in FIG. 6. However, additional connecting lines have been eliminated.

The connector 31 is connected through a recess in the cover plate 50 of the housing 39 directly to the interior space of the induction control valve 4. At the other end of the common housing 39, the connector 34 is connected through a channel 51 that is machined out of the housing 4 and which runs vertically, to the cylinder space below the adjusting piston 5 of the induction control valve so that here, too, it is possible to eliminate a connecting line.

This, then, is a combined easily installed structural unit that takes up very little space and performs all the functions required to reduce pressure rapidly during idling operation and when the compressor is shut down.

I claim:

1. A device for reducing the pressure of a compressor in the idling and shut-down mode in a pressure system of the type comprising an induction control valve for controlling the passage of a medium through an intake manifold, a bypass channel for bypassing the induction control valve and whose output leads through a pressure accumulator to a user, and an adjusting means for the induction control valve that is activated by the pressure in the pressure accumulator, said adjusting means including a return line that can be shut off by a first pressure relief valve leading back to the induction valve, said device being incorporated in said return line and comprising a first spring-loaded, pressure keeper valve that can be adjusted to the desired pressure, and an additional second pressure relief valve that is arranged in parallel with said first pressure relief valve, said second pressure relief valve being acted on by pressure immediately upstream of the compressor, and said second pressure relief valve opening an additional relief path as soon as said pressure exceeds a predetermined level when the compressor is in the shut-down mode.

2. A device as claimed in claim 1, wherein said pressure keeper valve and said first and second pressure relief valves are located in a common housing to form a pressure-reducing unit.

3. A device as claimed in claim 2, wherein the common housing for the pressure-reducing unit is combined with a housing of the induction control valve to form a common structural element.

4. A device as claimed in claim 2 or claim 3, wherein the common housing of the pressure-reducing unit comprises a cylinder, in two end sections of which there is, in each case, a piston that effectively seals the bore between the two pistons; the cylinder bore is divided by two partitions, each of which has a central bore and through each of which an extension of one of the two pistons passes, one bore being provided as a guide for the one piston that is loaded in the direction towards the bore by a spring and which rests against a partition that incorporates the bore so as to seal it, and an extension of the second piston passing through the other bore, said second piston having in the area of its end, a seal that seals the bore in the partition where it passes through it; and wherein the housing incorporates five connectors, of which one said connector leads into the cylinder space on the spring-loaded side of one said piston and is connected with the control line for the induction control valve, a second said connector leads into the cylinder space of the opposite piston that is connected with the induction manifold immediately upstream of the compressor, the third connector leads into a space between the two partitions in the cylinder bore, to which the pressure accumulator is connected and which can be connected with a fourth said connector and with a fifth said connector through the two pistons, either in alternation or together depending on the level of the pressure that is introduced, said fourth and fifth connectors passing to the atmosphere or opening into the induction manifold through the pressure relief lines.

5. A device as claimed in any one of claims 1 to 3, including a solenoid valve and an adjustable delay relay that delays the closure of the first pressure relief valve when the compressor is started up.

6. A device as claimed in claim 5, wherein the delay relay is incorporated in the power supply line of the solenoid valve that activates the relief valve of the pressure keeper valve.

* * * * *